US007709716B1

(12) United States Patent
Chen

(10) Patent No.: US 7,709,716 B1
(45) Date of Patent: May 4, 2010

(54) FOLDABLE MUSIC PEDAL

(76) Inventor: Kuo-Chang Chen, No. 218, Ln. 39, Sec. 1, Yongxing Rd., Wuqui Chen, Taichung Hsien (TW)

( * ) Notice: Subject to any disclaimer, the term of this patent is extended or adjusted under 35 U.S.C. 154(b) by 0 days.

(21) Appl. No.: 12/511,308

(22) Filed: Jul. 29, 2009

(51) Int. Cl.
*G10D 13/02* (2006.01)

(52) U.S. Cl. ..... 84/422.1

(58) Field of Classification Search ..... 84/422.1, 84/422.2, 422.3, 426
See application file for complete search history.

(56) References Cited

U.S. PATENT DOCUMENTS 6,188,007 B1 * 2/2001 Liao ..... 84/422.3

* cited by examiner

*Primary Examiner*—Kimberly R Lockett
(74) *Attorney, Agent, or Firm*—Rabin & Berdo, P.C.

(57) ABSTRACT

A foldable music pedal has a stand, a base assembly and a pedal. The stand has a cross bar, a seat and a moving element. The cross bar is defined opposite to the seat. The seat has an inserting recess. The moving element is retractably mounted through the cross bar. The base assembly has a casing base and an inserting base. The casing base is connected pivotally to the seat. The inserting base is movably inserted through the casing base and inserted into the inserting recess of the seat of the stand, and has a connecting end and a bolt. The connecting end of the inserting base extends out of the casing base opposite to the stand. The bolt detachably connects to the casing base and the inserting base. The pedal has two ends respectively connected pivotally to the connecting end of the inserting base and the moving element.

12 Claims, 8 Drawing Sheets

FOLDABLE MUSIC PEDAL

BACKGROUND OF THE INVENTION

1. Field of the Invention

The present invention relates to a music pedal, and more particularly to a foldable music pedal with a foldable base assembly to improve the convenience of carrying or storing the music pedal.

2. Description of Related Art

With reference to FIGS. 6 to 8, a conventional foldable music pedal has a stand (61), a tripod, a base assembly (62) and a pedal (63). The stand (61) connects to the base assembly (62), the pedal (63) and a musical instrument such as a hi-hat cymbal, and has a mounting frame (610), a supporting frame (613) and a tripod. The mounting frame (610) has a cross bar and two posts. The cross bar is mounted on and between the posts. Each post has a connecting end, a connecting mount (611) and a connecting hole (612). The connecting mount (611) protrudes from the connecting end of the post. The connecting hole (612) is formed through the connecting mount (611). The supporting frame (613) is mounted on the cross bar of the mounting frame (610), may be a tube, and has a shaft (614), a chain (615) and a protruding end. The shaft (614) is moveably inserted in the supporting frame (613) and has a connecting end. The connecting end is extended through the cross bar of the mounting frame (610). The chain (615) is connected to the connecting end of the shaft (614). The protruding end protrudes from the tube and may connect to the hi-hat cymbal. The tripod is mounted on the stand (61) and provides a supporting effect.

The base assembly (62) has a supporting base (620), two bars (621) and a heel mount (623). Each bar (621) has a proximal end and a distal end. The proximal end of the bar (621) is fixed on the supporting base (620). The distal end of the bar (621) is extended toward the stand (61) and has a connecting rod (622) perpendicularly protruding from the distal end of the bar (621) and mounted retractably in the connecting hole (612) of the mounting frame (610). The heel mount (623) is mounted on the supporting base (620). The pedal (63) has two ends respectively connected pivotally to the heel mount (623) and the chain (615), and is activated to pull the chain (615) and drive the shaft (614).

When the distal ends of the bars (621) are pressed to move out from the connecting holes (612) of the mounting frame (610), the base assembly (62) and the pedal (63) can be folded toward the stand (61) and may be bound on the stand (61) by a rope.

However, even if the base assembly (62) and the pedal (63) are folded and bound on the stand (61), the base assembly (62) and the pedal (63) still move or swing easily and cannot be held steadily on the stand (61) because the pedal (63) is only connected to the stand (61) by the chain (615).

To overcome the shortcomings, the present invention tends to provide a foldable music pedal to mitigate or obviate the aforementioned problems.

SUMMARY OF THE INVENTION

The main objective of the invention is to provide a foldable music pedal to improve convenience of carrying or storing the music pedal.

The foldable music pedal has a stand, a base assembly and a pedal. The stand has a cross bar, a seat and a moving element. The cross bar is defined opposite to the seat. The seat has an inserting recess. The moving element is retractably mounted through the cross bar. The base assembly has a casing base and an inserting base. The casing base is connected pivotally to the seat. The inserting base is movably inserted through the casing base and inserted into the inserting recess of the seat of the stand, and has a connecting end and a bolt. The connecting end of the inserting base is extends of the casing base opposite to the stand. The bolt detachably connects to the casing base and the inserting base. The pedal has two ends respectively connected pivotally to the connecting end of the inserting base and the moving element.

Other objects, advantages and novel features of the invention will become more apparent from the following detailed description when taken in conjunction with the accompanying drawings.

DETAILED DESCRIPTION OF PREFERRED EMBODIMENT

Figure 1:
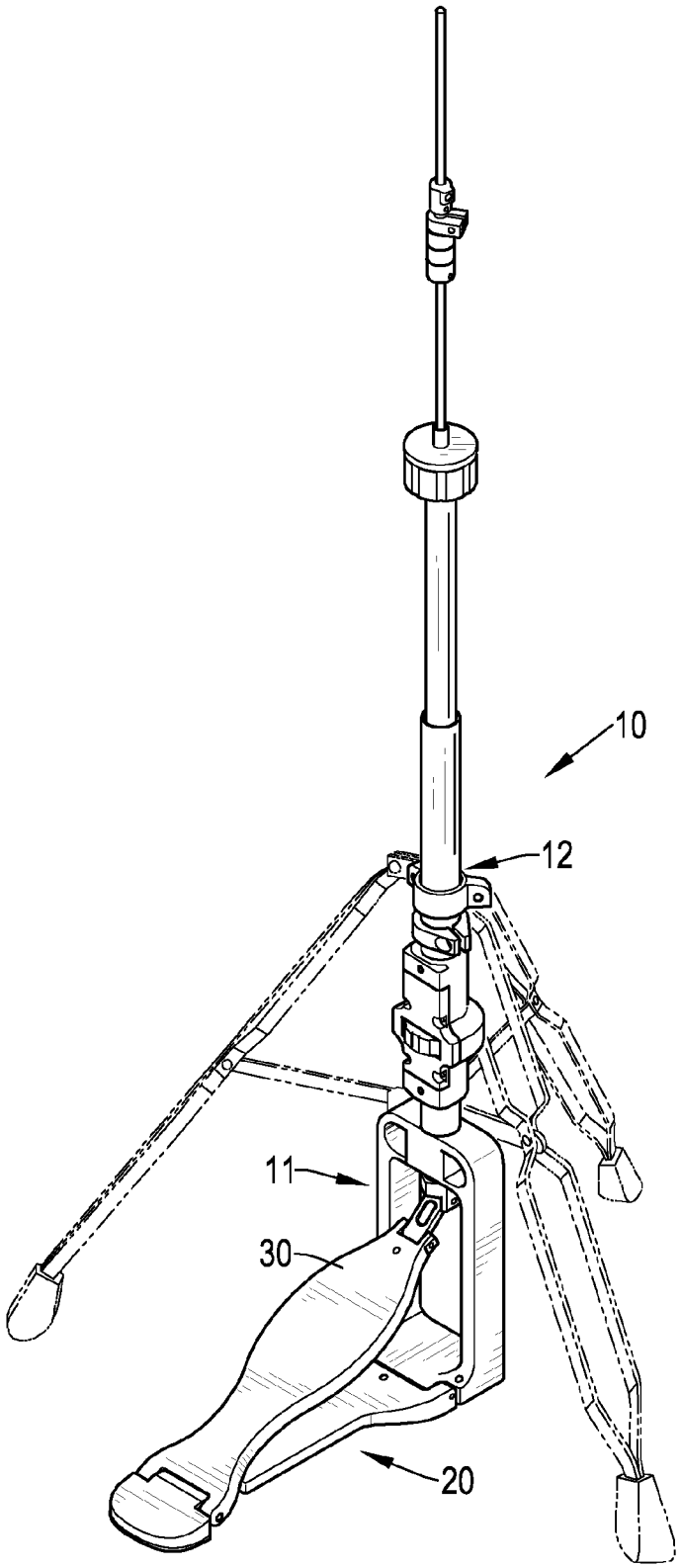
FIG. 1 is a perspective view of a foldable music pedal in accordance with the present invention.
Figure 2:
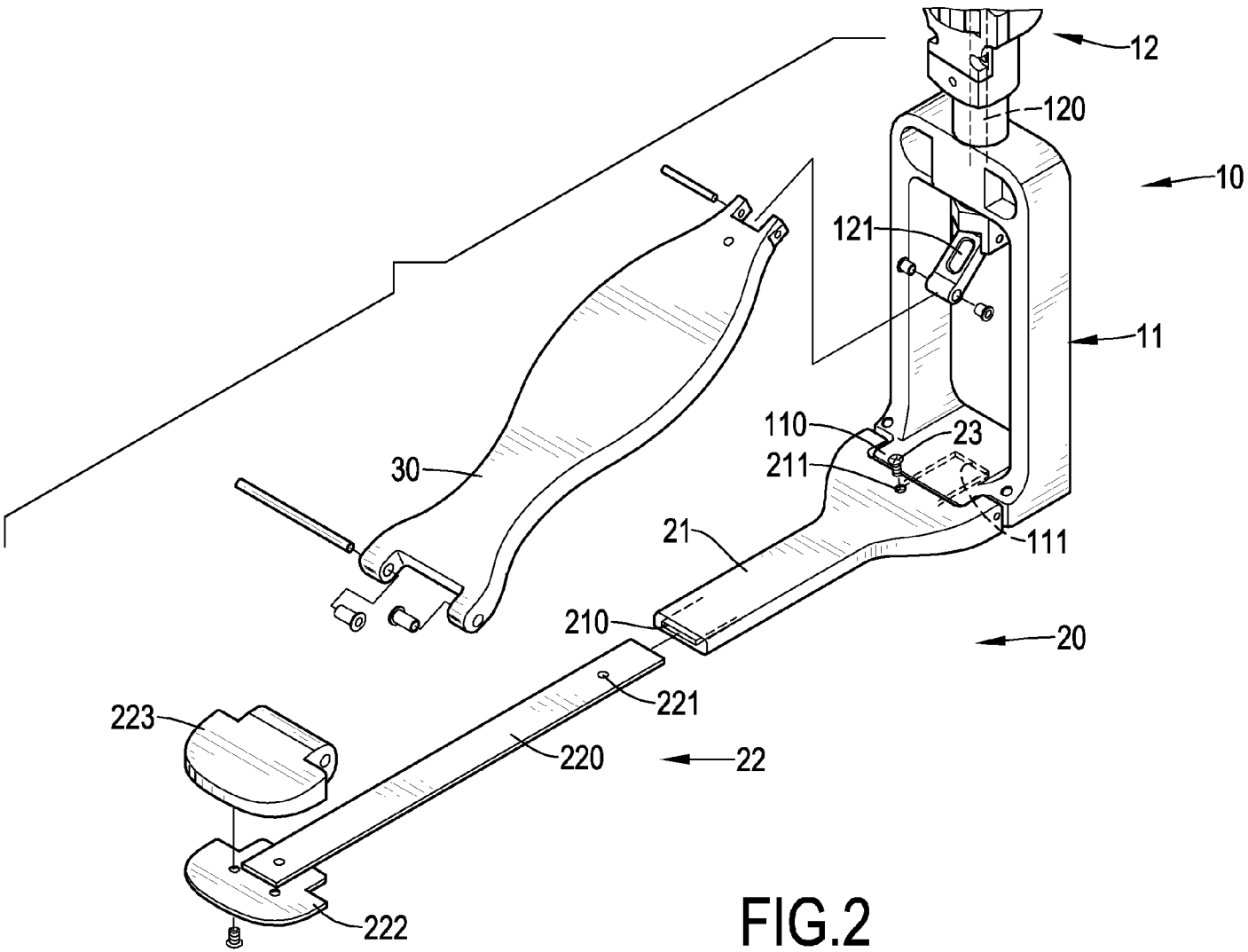
FIG. 2 is a partially exploded perspective view of the foldable music pedal in FIG. 1.
Figure 3:
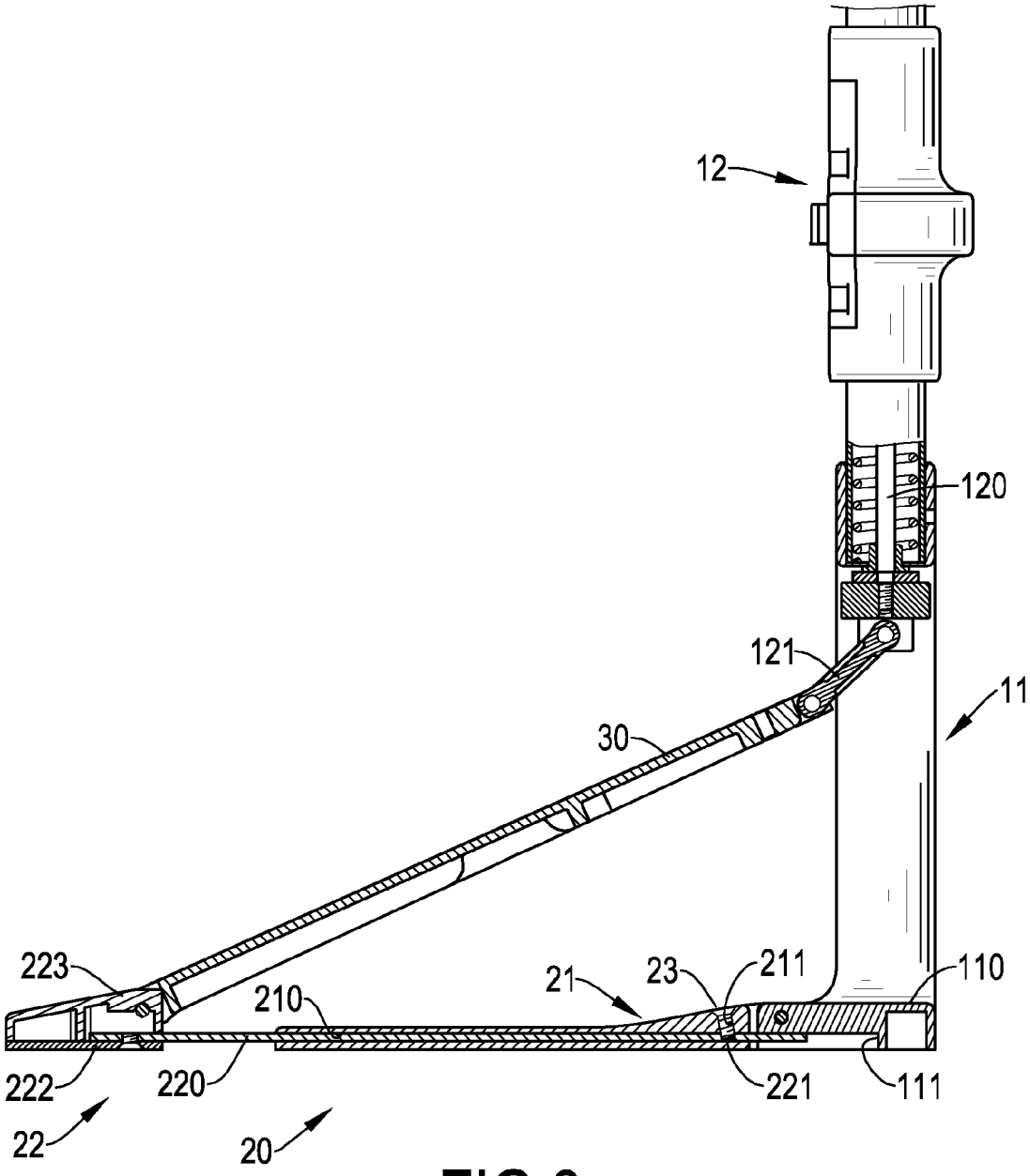
FIG. 3 is a side view in partial section of the foldable music pedal in FIG. 2.

With reference to FIGS. 1 to 3, a foldable music pedal in accordance with the present invention is applied to a percussion instrument, such as a hi-hat cymbal, and has a stand (10), a base assembly (20) and a pedal (30). The stand (10) has a mounting frame (11) and a supporting frame (12). The mounting frame (11) has two posts, a cross bar and a seat (110). The cross bar is mounted on and between the posts. The seat (110) is mounted between the posts opposite to the cross bar and protrudes toward the base assembly (20) and has a surface, a bottom and an inserting recess (111). The surface of the seat (110) is defined between the posts and faces the base assembly (20). The inserting recess (111) is formed in the surface of the seat (110), and may extend to the bottom of the seat (110).

The supporting frame (12) is mounted on the mounting frame (11) and may be a tube and has a moving element. The moving element is mounted in the supporting frame (12) and has a shaft (120) and a connector (121). The shaft (120) is moveably mounted in the supporting frame (12) and has a connecting end and a protruding end. The connecting end of the shaft (120) is extended through the cross bar of the mounting frame (11). The protruding end of the shaft (120) is opposite to the connecting end of the shaft (120), protrudes from the supporting frame (12) and may connect to the percussion instrument, such as the hi-hat cymbal. The connector (121) may be a rectangular block and has a stand end and a pedal end. The stand end of the connector (121) is connected pivotally to the connecting end of the shaft (120).

The base assembly (20) has a casing base (21), an inserting base (22) and a bolt (23). The casing base (21) has a pivoting end, a casing end, an inserting hole (210) and a fixing hole (211). The pivoting end of the casing base (21) is connect pivotally to the seat (110) of the mounting frame (11) and may have a recess in a shape corresponding to that of the seat (110). The casing end is opposite to the pivoting end. The inserting hole (210) is formed through the casing base (21) from the inserting end to the pivoting end, communicates with the inserting recess (111) of the mounting frame (11) and may be rectangular in cross section. The fixing hole (211) is formed in the pivoting end of the casing base (21), communicates with the inserting hole (210) and may be a threaded hole.

The inserting base (22) has an inserting board (220), a supporting board (222) and a heel mount (223). The inserting board (220) is elongated, movably mounted through the inserting hole (210) and inserted into the inserting recess (111), may be a rectangular board, and has a fixing recess (221) and a connecting end. The fixing recess (221) is formed in the inserting board (220) and aligns with the fixing hole (211) of the casing base (21). The connecting end of the inserting board (220) is extended out from the inserting hole (210). The supporting board (222) is connected to the connecting end of the inserting board (220). The heel mount (223) is mounted on the supporting board (222).

The bolt (23) is detachably mounted through the fixing hole (211) of the casing base (21), is mounted in the fixing recess (221) of the inserting base (21) to connect the inserting base (22) securely with the casing base (21) and may be a screw.

The pedal (30) has a base end and a frame end. The base end of the pedal (30) is connected pivotally to the heel mount (223) of the inserting base (220). The frame end of the pedal (30) is connected pivotally to the pedal end of the connector (121) and may have a rectangular recess in a shape corresponding to the shape of the connector (121).

Figure 4:
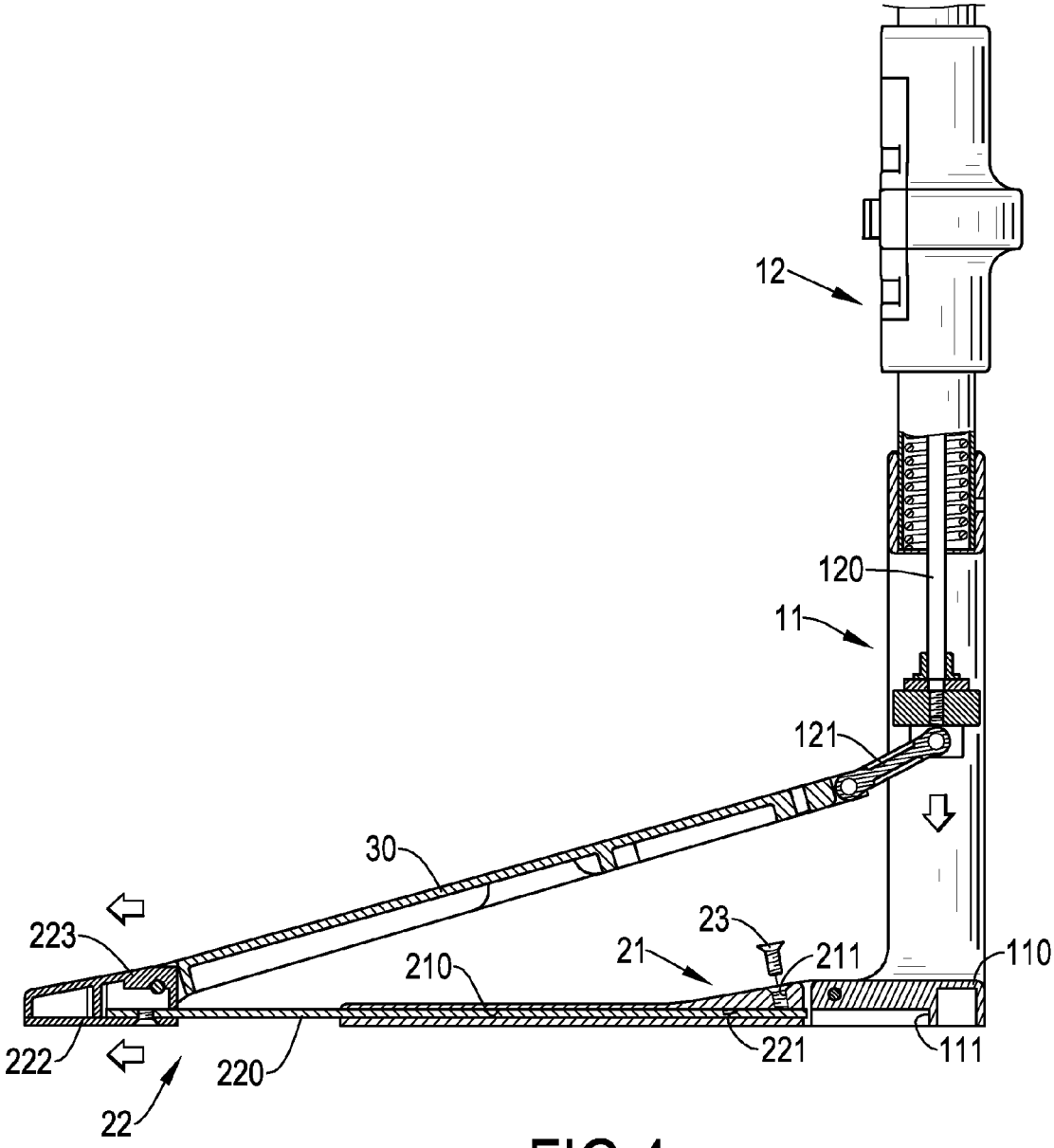
FIG. 4 is an operational side view in partial section of the foldable music pedal in FIG. 3.
Figure 5:
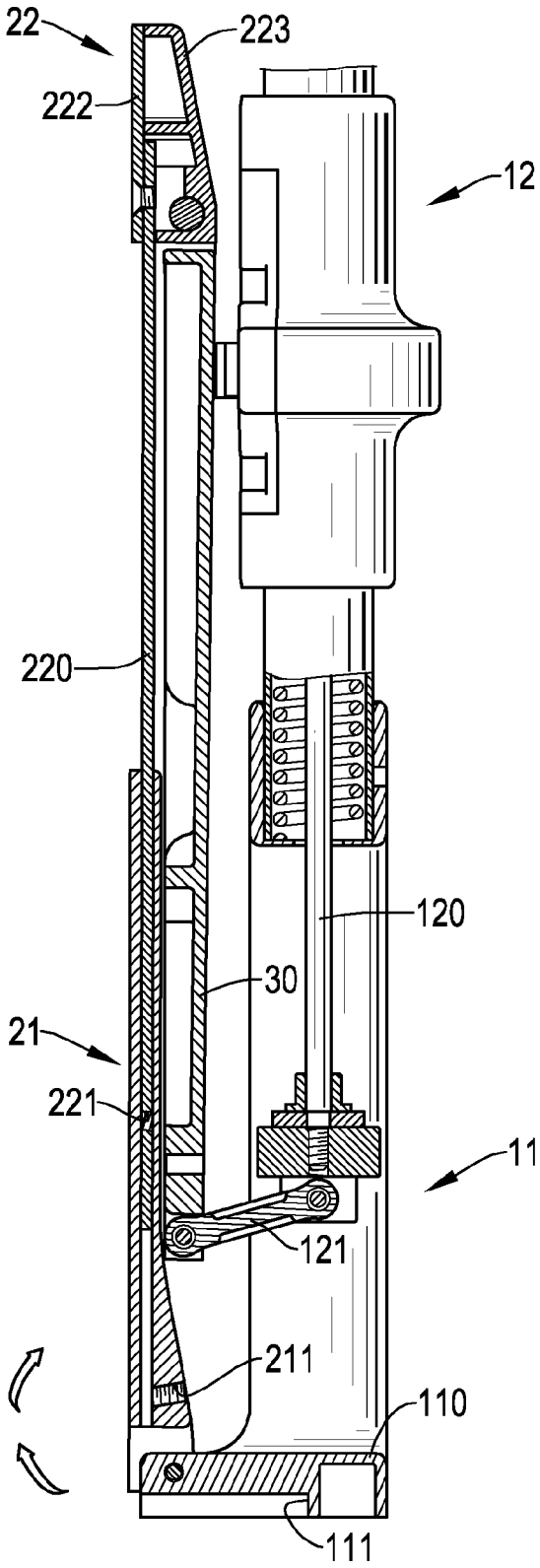
FIG. 5 is an enlarged operational side view in partial section of the foldable music pedal in FIG. 3.
Figure 6:
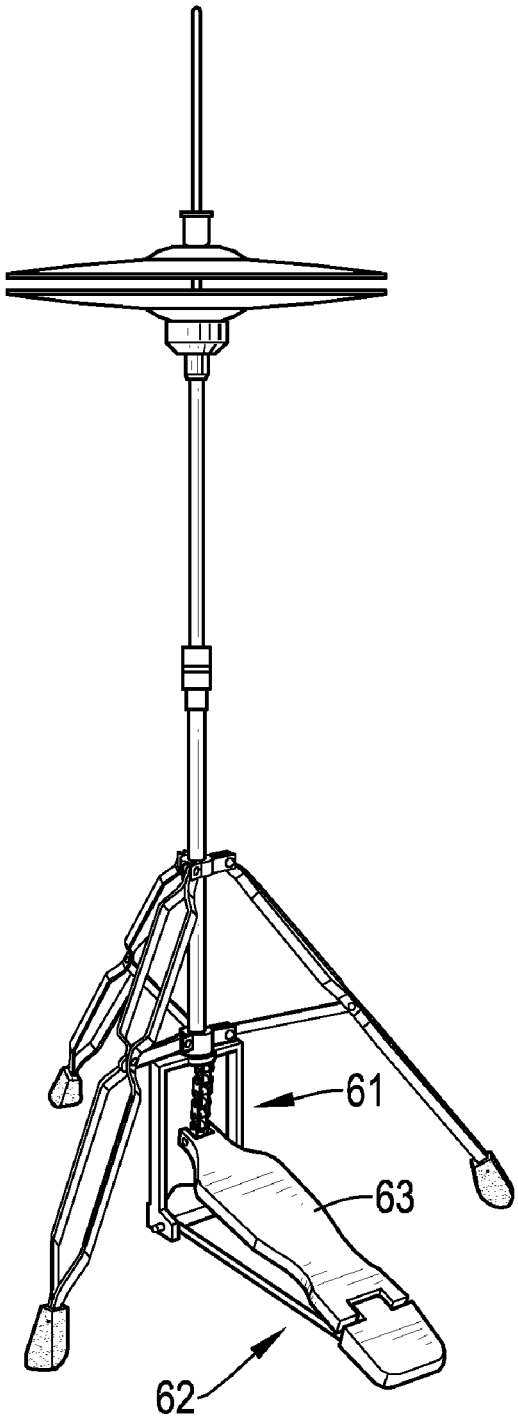
FIG.6 PRIOR ART
FIG. 6 is a perspective view of a conventional foldable music pedal in accordance with the prior art.
Figure 7:
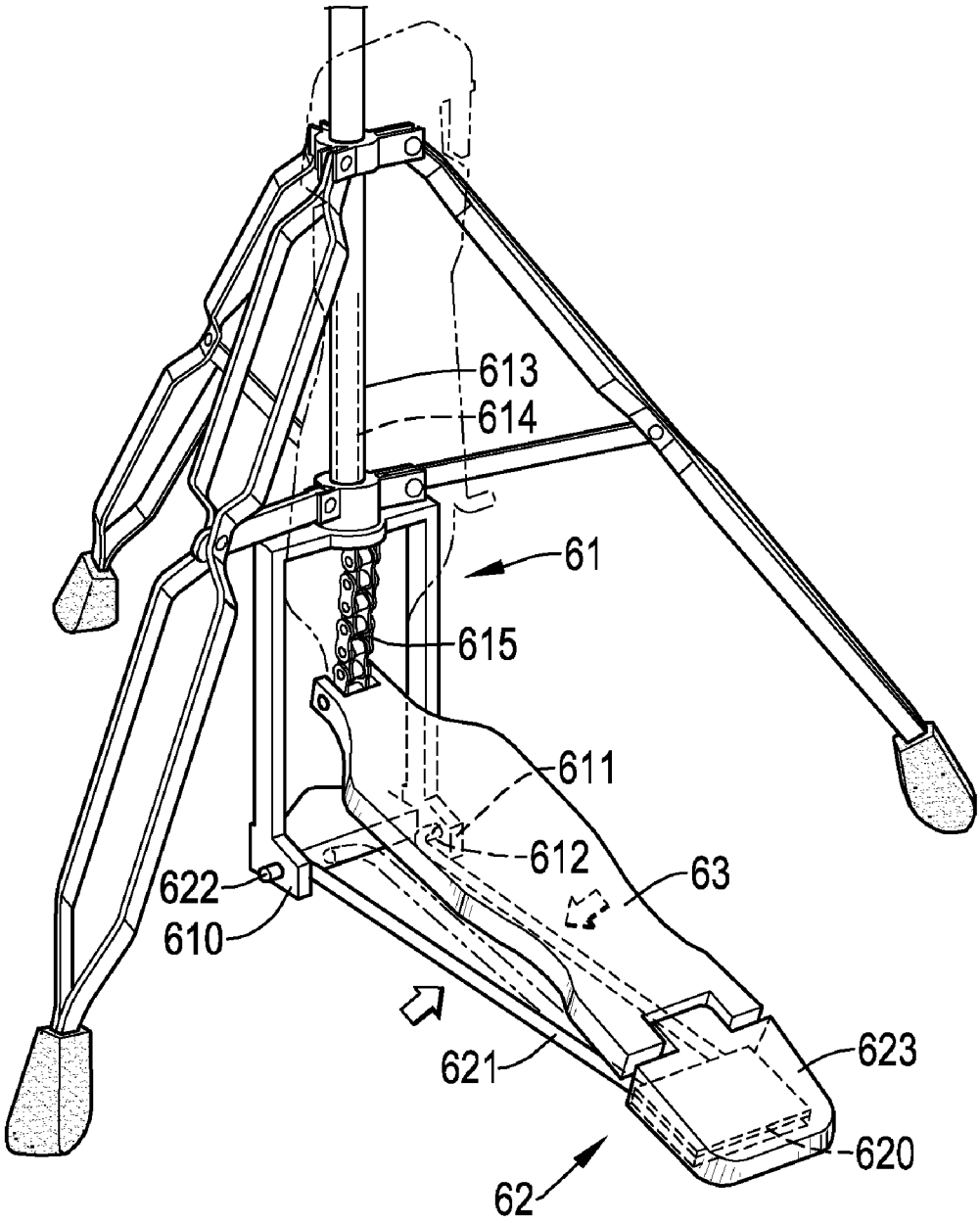
FIG.7 PRIOR ART
FIG. 7 is an enlarged perspective view of the conventional foldable music pedal in FIG. 6.
Figure 8:
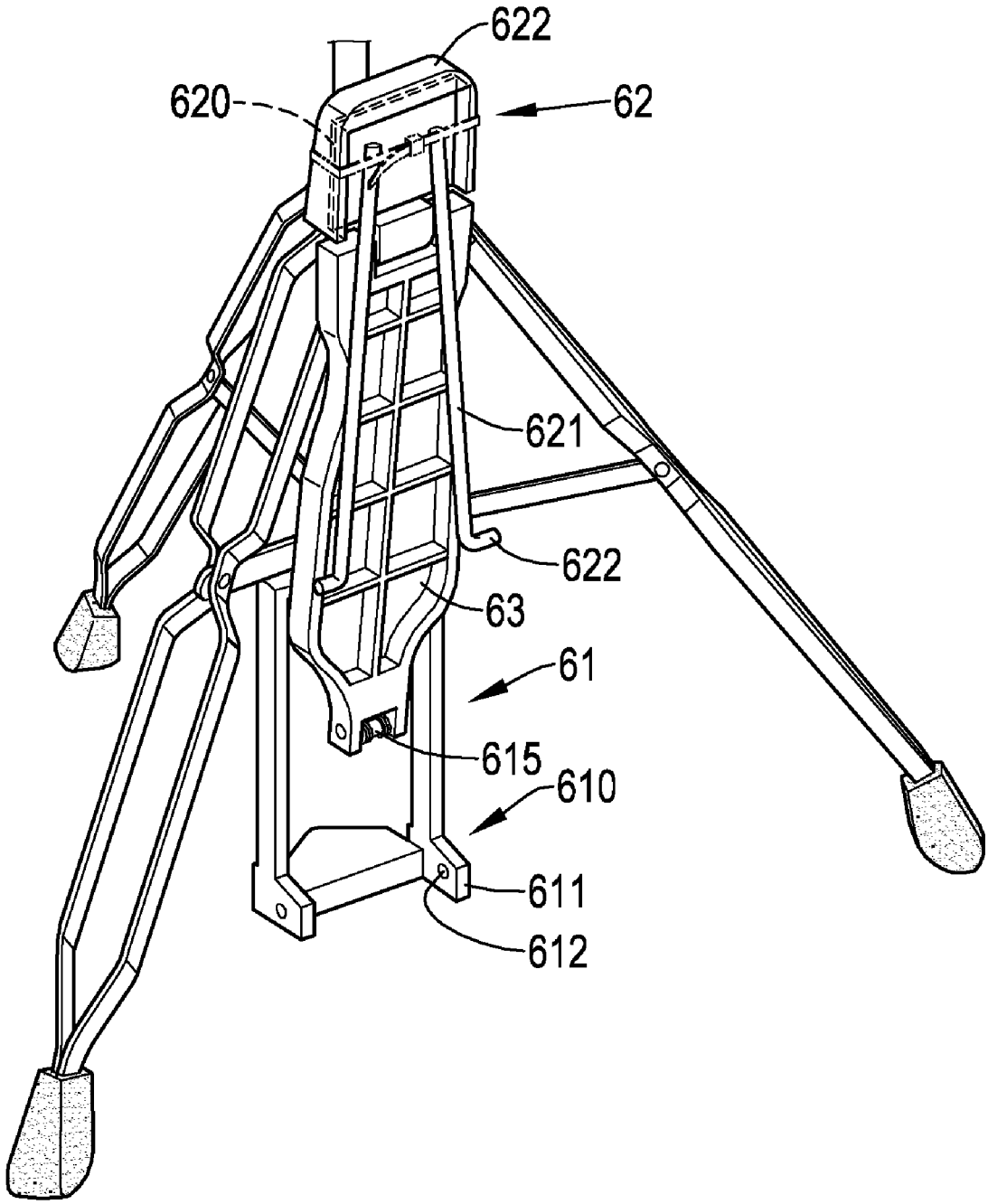
FIG.8 PRIOR ART
FIG. 8 is an enlarged operational perspective view of the conventional foldable music pedal in FIG. 6.

With reference to FIGS. 4 and 5, to fold the foldable music pedal, the bolt (23) is firstly released, and the pedal (30) is pressed to pull the connector (121) and the shaft (120) downward. The inserting base (22) is pulled out from the inserting recess (111), and the base assembly (20) and the pedal (30) are pivoted toward the stand (10). Consequently, the base assembly (20) and the pedal (30) can be bound on the stand (10) with a rope or the like. The base assembly (20) and the pedal (30) can be held steadily and kept from moving and swinging because the inserting board (220) is held and limited in the inserting hole (210). With the base assembly (20) and the pedal (30) folded, the folded foldable music pedal is easily and conveniently stored or carried.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A foldable music pedal comprising:
- a stand having
  - a mounting frame having
    - two posts;
    - a cross bar mounted on and between the posts;
    - a seat mounted between the posts opposite to the cross bar and having
      - a surface defined between the posts;
      - an inserting recess formed in the surface of the seat; and
    - a supporting frame mounted on the mounting frame and having a moving element;
  - a base assembly having
    - a casing base having
      - a pivoting end connected pivotally to the seat;
      - a casing end opposite to the pivoting end;
      - an inserting hole formed through the casing base from the inserting end to the pivoting end and communicating with the inserting recess of the mounting frame; and
      - a fixing hole formed in the pivoting end of the casing base and communicating with the inserting hole;
    - an inserting base having
      - an inserting board movably mounted through the inserting hole, inserted in the inserting recess and having
        - a fixing recess formed in the inserting board and aligning with the fixing hole of the casing base; and and
        - a connecting end extended out from the inserting hole;
    - a heel mount mounted on the connecting end of the inserting base;
    - a bolt detachably mounted through the fixing hole of the casing base and mounted into the fixing recess of the inserting base;
  - a pedal having
    - a base end connected pivotally to the heel mount of the inserting base; and
    - a frame end connected pivotally to the moving element.

2. The foldable music pedal as claimed in claim 1, wherein the pivoting end of the casing base further has a recess in a shape corresponding to that of the seat.

3. The foldable music pedal as claimed in claim 1, wherein the moving element further has
- a shaft moveably mounted in the supporting frame and having a connecting end extended through the cross bar of the mounting frame; and
- a connector connected pivotally on the connecting end of the shaft;
- the frame end of the pedal is connected pivotally to the connector of the moving element.

4. The foldable music pedal as claimed in claim 2, wherein the moving element further has
- a shaft moveable mounted in the supporting frame and has a connecting end extended through the cross bar of the mounting frame; and
- a connector connected pivotally on the connecting end of the shaft;
- the frame end of the pedal is connected pivotally to the connector of the moving element.

5. The foldable music pedal as claimed in claim 1, wherein the inserting hole is rectangular in cross section; and the inserting board is a rectangular board.

6. The foldable music pedal as claimed in claim 2, wherein the inserting hole is rectangular in cross section; and the inserting board is a rectangular board.

7. The foldable music pedal as claimed in claim 4, wherein the inserting hole is rectangular in cross section; and the inserting board is a rectangular board.

8. The foldable music pedal as claimed in claim 1, wherein the fixing hole is a threaded hole; and the bolt is a screw.

9. The foldable music pedal as claimed in claim 2, wherein the fixing hole is a threaded hole; and the bolt is a screw.

10. The foldable music pedal as claimed in claim 7, wherein the fixing hole is a threaded hole; and the bolt is a screw.

11. The foldable music pedal as claimed in claim 3, wherein the shat further has a protruding end being opposite to the connecting end of the shaft and protruding out from the supporting frame.

12. The foldable music pedal as claimed in claim 10, wherein the shat further has a protruding end being opposite to the connecting end of the shaft and protruding out from the supporting frame.

* * * * *